US011815256B1

(12) United States Patent
Wang

(10) Patent No.: US 11,815,256 B1
(45) Date of Patent: Nov. 14, 2023

(54) CEILING FAN LIGHT STRUCTURE

(71) Applicant: AIR COOL INDUSTRIAL CO., LTD., Taichung (TW)

(72) Inventor: Cliff Wang, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 17/934,985

(22) Filed: Sep. 23, 2022

(51) Int. Cl.
*F21V 33/00* (2006.01)
*F21V 23/06* (2006.01)

(52) U.S. Cl.
CPC ..... *F21V 33/0096* (2013.01); *F21V 23/06* (2013.01)

(58) Field of Classification Search
CPC ..... F21V 33/0096
See application file for complete search history.

(56) References Cited

U.S. PATENT DOCUMENTS

2008/0132117 A1* 6/2008 Colosio ..... H01R 33/09 439/619

* cited by examiner

*Primary Examiner* — Anabel Ton
(74) *Attorney, Agent, or Firm* — Sinorica International Patent & Trademark

(57) ABSTRACT

A ceiling fan light structure includes a light housing, a light, a plurality of first conductive elements, and a plurality of second conductive elements. The light housing and the light are fastened to each other through a plurality of locking slots and a plurality of locking members. When the light housing and the light are assembled, the first conductive elements are elastically abutted against and electrically connected to the second conductive elements, so that the assembly and electrical connection can be quickly completed at the same time. The light housing and the light can be disassembled quickly to release the electrical connection.

10 Claims, 8 Drawing Sheets

CEILING FAN LIGHT STRUCTURE

FIELD OF THE INVENTION

The present invention relates to a ceiling fan light structure, and more particularly to a ceiling fan light structure comprising a light housing and a light module that can be assembled quickly.

BACKGROUND OF THE INVENTION

In general, a ceiling fan is installed to the ceiling. The ceiling fan is equipped with a light housing. A light module is locked to the light housing with screws. The light housing and the light module are electrically connected through a plurality of wires and a plurality of electrical connection terminals. When the ceiling fan is to be installed to the ceiling, it needs to be assembled, disassembled, and readjusted. Disassembly and assembly becomes a complicated, difficult and dangerous work for maintenance.

Accordingly, the inventor of the present invention has devoted himself based on his many years of practical experiences to solve these problems.

SUMMARY OF THE INVENTION

The primary object of the present invention is to provide a ceiling fan light structure. The ceiling fan light structure comprises a light housing and a light module. The assembly and electrical connection between the light housing and the light module can be quickly completed at the same time. The light housing and the light module can be disassembled quickly to release the electrical connection, thereby improving the convenience in use.

In order to achieve the above object, the present invention provides a ceiling fan light structure. The ceiling fan light structure is electrically connected to a power source. The power source has a power source positive electrode and a power source negative electrode. The ceiling fan light structure comprises a light housing, a light module, a coupling unit, and a conductive unit. The light module has a light positive electrode and a light negative electrode. The coupling unit includes a plurality of locking slots and a plurality of locking members. The locking slots are disposed on one of the light housing and the light module. The locking members are disposed on the other one of the light housing and the light module. The locking members correspond to the locking slots. The locking members are fastened to the locking slots. The conductive unit includes a plurality of conductive elements. The conductive elements each have a first end and a second end. The conductive elements include two first conductive elements that are spaced apart from each other and connected to the light housing and two second conductive elements that are spaced apart from each other and connected to the light module. The first conductive elements are not electrically connected to each other. The second conductive elements are not electrically connected to each other. One of the first conductive elements and the second conductive elements are flexible. The first conductive elements are defined as a first positive conductive element and a first negative conductive element. A first end of the first positive conductive element is electrically connected to the power source positive electrode. A first end of the first negative conductive element is electrically connected to the power source negative electrode. The second conductive elements are defined as a second positive conductive element and a second negative conductive element.

A first end of the second positive conductive element is electrically connected to the light positive electrode. A first end of the second negative conductive element is electrically connected to the light negative electrode.

In the ceiling fan light structure provided by the present invention, the light housing and the light module can be quickly connected through the locking slots and the locking members. When the light housing and the light module are connected, a second end of the first positive conductive element is elastically abutted against and electrically connected to a second end of the second positive conductive element, and a second end of the first negative conductive element is elastically abutted against and electrically connected to a second end of the second negative conductive element, so as to complete an electrical connection between the light housing and the light module. The assembly and electrical connection between the light housing and the light module can be quickly completed at the same time. The light housing and the light module can be disassembled quickly to release the electrical connection, thereby improving the convenience in use.

DETAILED DESCRIPTION OF THE PREFERRED EMBODIMENTS

Embodiments of the present invention will now be described, by way of example only, with reference to the accompanying drawings.

Figure 1:
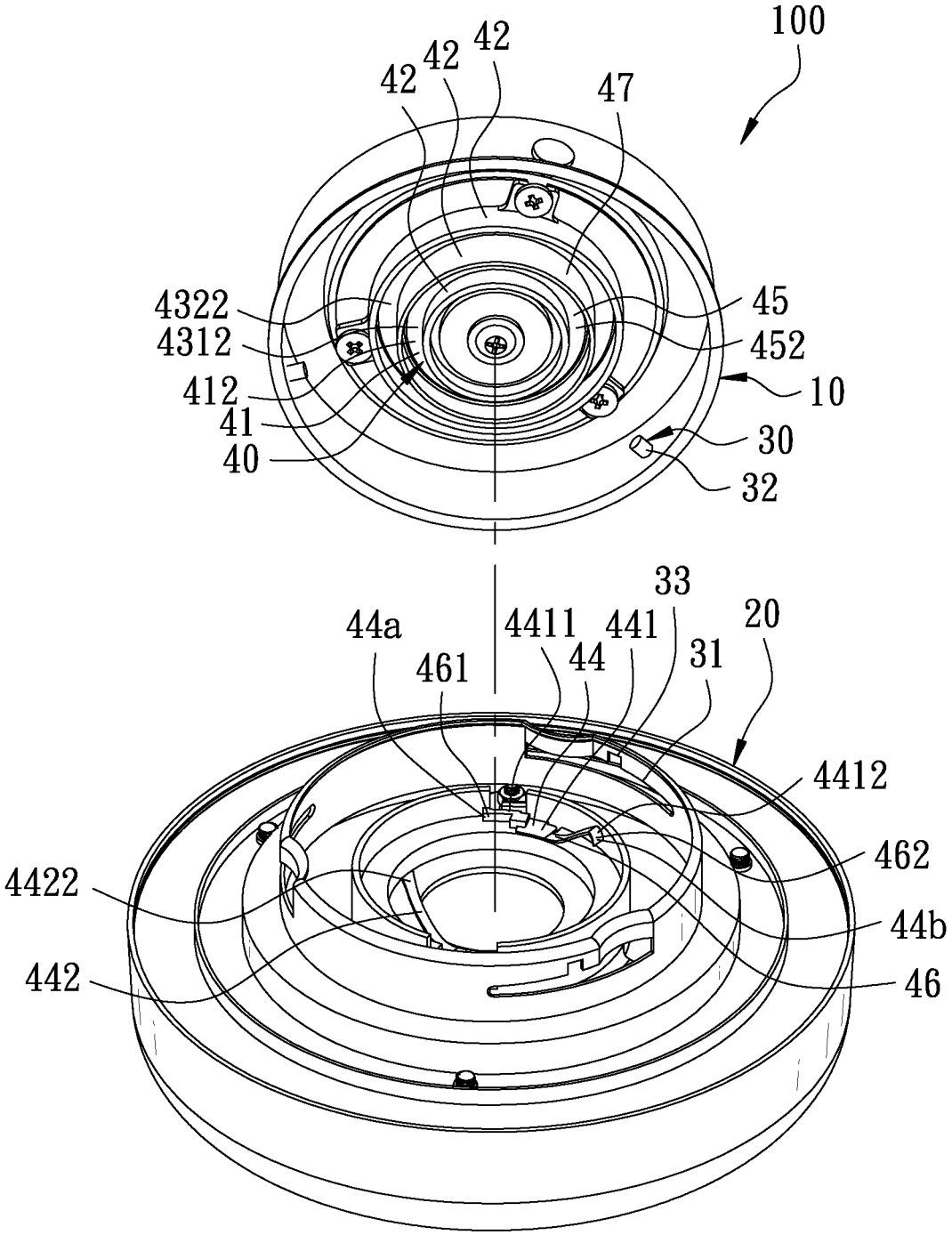
FIG. 1 is a schematic view in accordance with an embodiment of the present invention.
Figure 2:
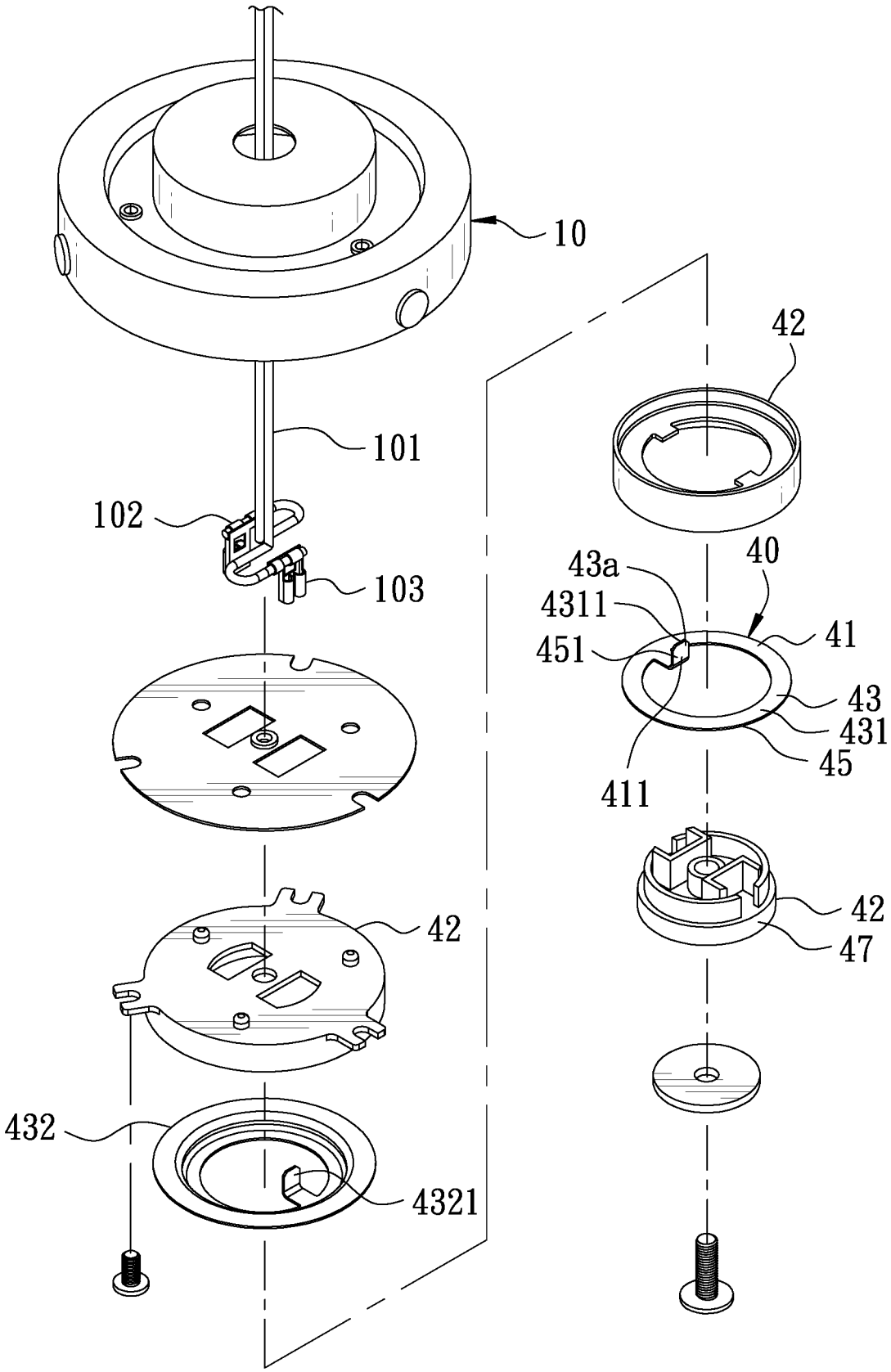
FIG. 2 is a partial exploded view in accordance with the embodiment of the present invention, illustrating the light housing, the seat and the conductive element.
Figure 3:
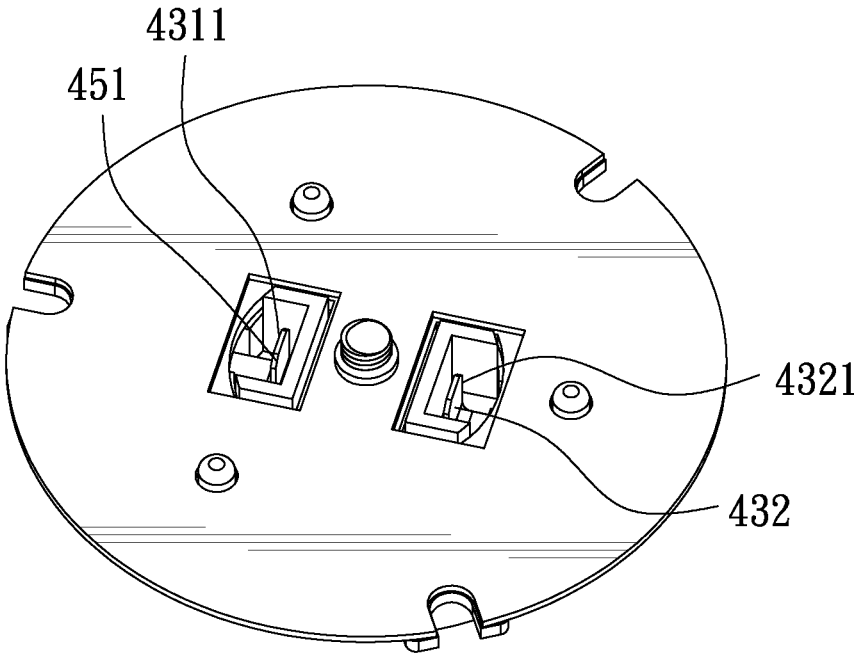
FIG. 3 is a schematic view in accordance with the embodiment of the present invention, illustrating the first conductive element.
Figure 4:
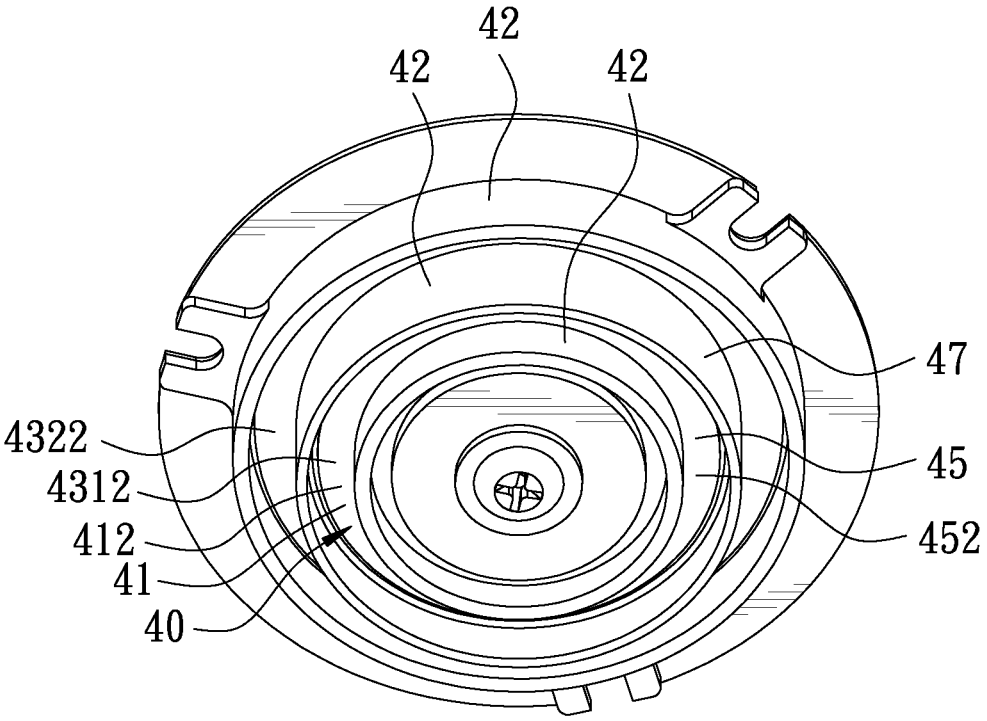
FIG. 4 is a schematic view in accordance with the embodiment of the present invention, illustrating the light housing, the seat and the first conductive element.
Figure 5:
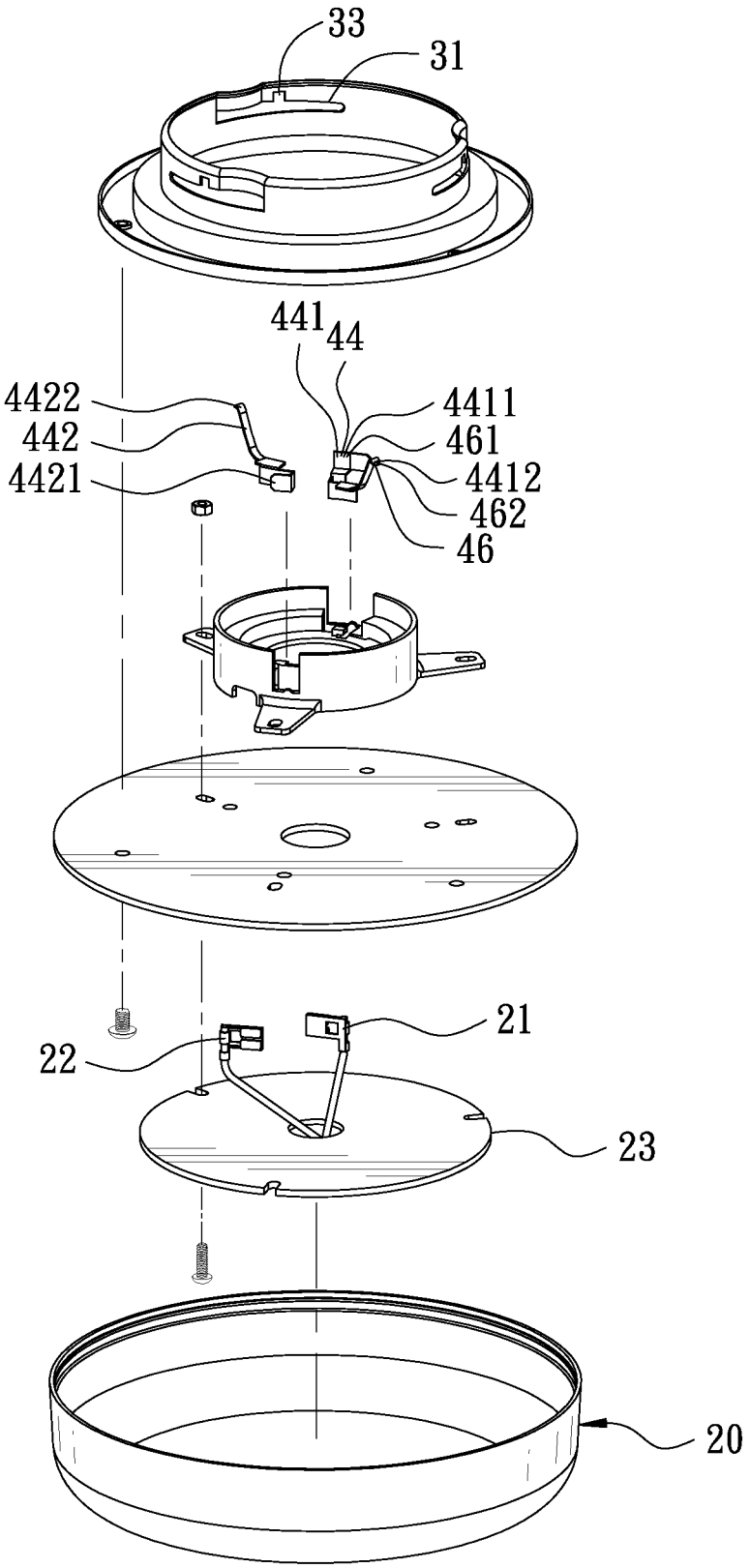
FIG. 5 is a partial exploded view in accordance with the embodiment of the present invention, illustrating the light module, the locking slot and the second conductive element.
Figure 6:
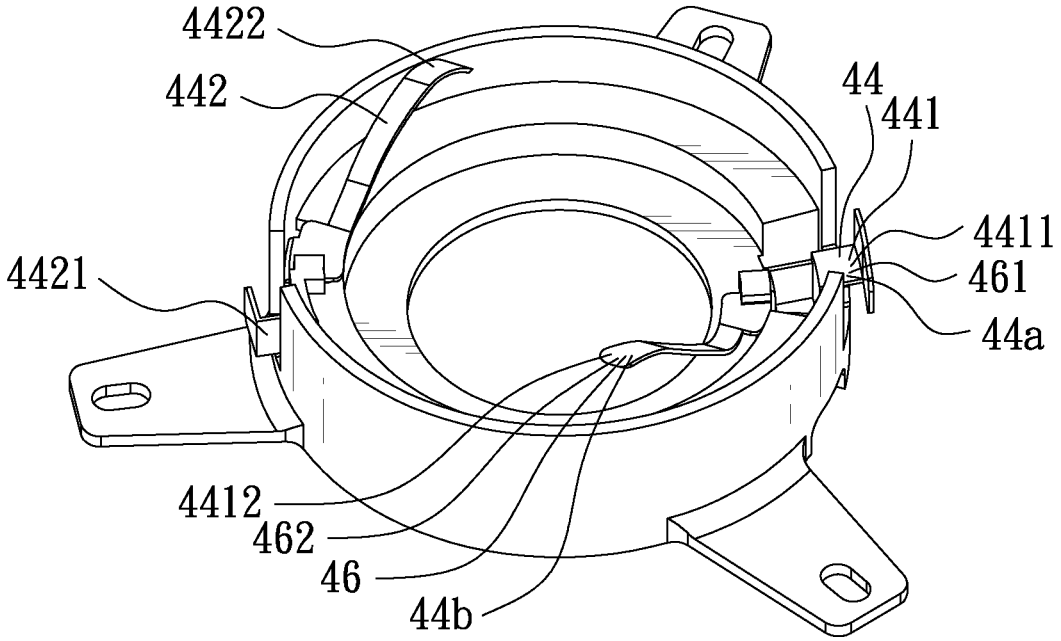
FIG. 6 is a schematic view in accordance with the embodiment of the present invention, illustrating the second conductive element.
Figure 7:
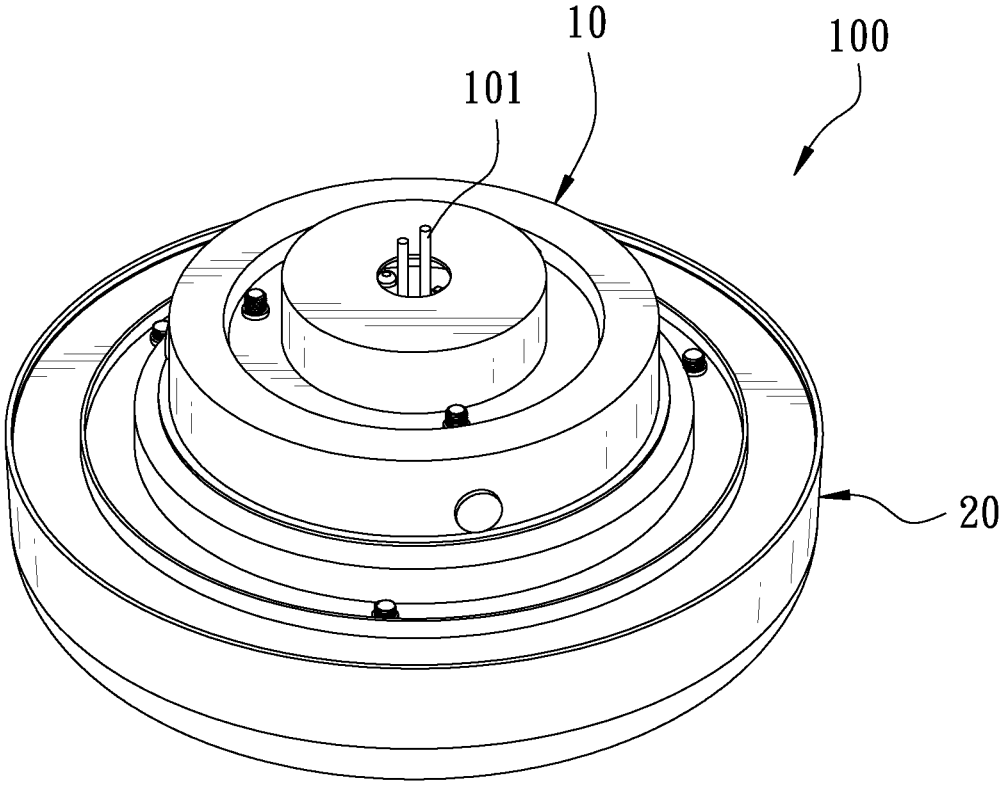
FIG. 7 is a schematic view in accordance with the embodiment of the present invention, illustrating the assembly of the light module and the light housing.
Figure 8:
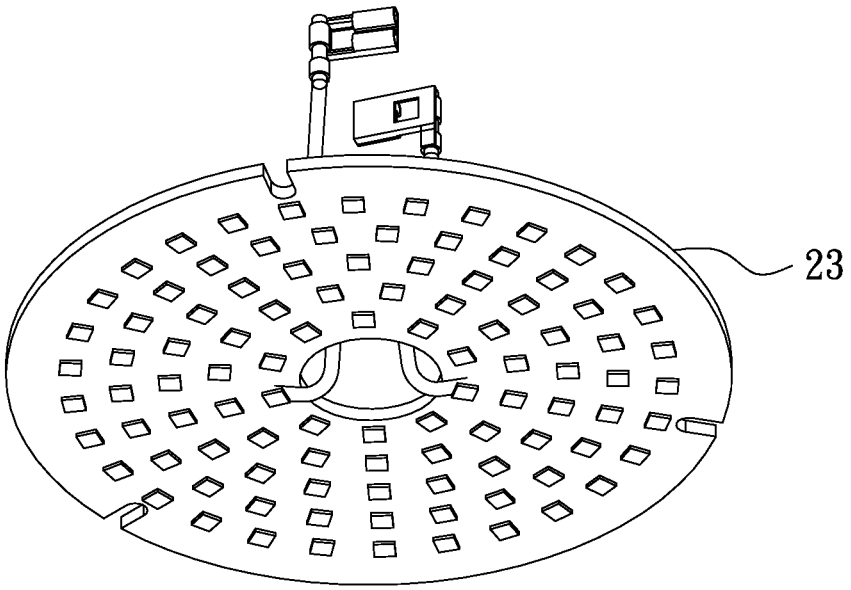
FIG. 8 shows the light source, a light positive electrode 21 and a light negative electrode 22 of the light module.

As shown in FIG. 1 through FIG. 7, the present invention discloses a ceiling fan light structure 100 electrically connected to a power source 101. The power source 101 has a power source positive electrode 102 and a power source negative electrode 103. The ceiling fan light structure 100 comprises a light housing 10, a light module 23, a coupling unit 30, and a conductive unit 40.

The light module 23 is disposed under the light housing 10. The light module 23 comprises a light positive electrode 21, a light negative electrode 22 and a light housing case 20.

The coupling unit 30 includes a plurality of locking slots 31 and a plurality of locking members 32. The locking slots 31 are disposed on one of the light housing 10 and the light module 23. The locking members 32 are disposed on the other one of the light housing 10 and the light module 23. The locking members 32 correspond to the locking slots 31 for the light module 23 to be rotated relative to the light housing 10, so that the locking members 32 are moved and fastened to the locking slots 31. One side of each engaging slot 31 is a closed end for locking the corresponding locking member 32 in position. The other side of each engaging slot 31, adjacent to the corresponding locking member 32, is recessed to form a groove 33 extending toward the corresponding locking member 32. The other side of each engaging slot 31 is an open end. The grooves 33 of the locking slots 31 correspond to the locking members 32. When the locking members 32 are accidentally disengaged from the locking slots 31, the grooves 33 are configured to accommodate the locking members 32, so as to prevent the light module 23 from falling.

The conductive unit 40 includes a plurality of conductive elements 41 and three seats 42 made of an insulating material. The conductive elements 41 each have a first end 411 and a second end 412. The conductive elements 41 include two first conductive elements 43 that are spaced apart from each other and fixed to the light housing 10 and two second conductive elements 44 that are spaced apart from each other and fixed to the light module 23. The first conductive elements 43 are not electrically connected to each other. The second conductive elements 44 are not electrically connected to each other. One of the first conductive elements 43 and the second conductive elements 44 are flexible. The first conductive elements 43 are one of two conductive rings 45 and two conductive elastic plates 46. In this embodiment of the present invention, the first conductive elements 43 are the two conductive rings 45. The first conductive elements 43 are defined as a first positive conductive element 431 and a first negative conductive element 432. A first end 4311 of the first positive conductive element 431 is electrically connected to the power source positive electrode 102. A first end 4321 of the first negative conductive element 432 is electrically connected to the power source negative electrode 103. The second conductive elements 44 are the other one of the two conductive rings 45 and the two conductive elastic plates 46. In this embodiment of the present invention, the second conductive elements 44 are the two conductive elastic plates 46. The second conductive elements 44 are defined as a second positive conductive element 441 and a second negative conductive element 442. A first end 4411 of the second positive conductive element 441 is electrically connected to the light positive electrode 21. A first end 4421 of the second negative conductive element 442 is electrically connected to the light negative electrode 22. The first positive conductive element 431 corresponds to the second positive conductive element 441. The first negative conductive element 432 corresponds to the second negative conductive element 442. The conductive rings 45 are each fastened between every adjacent two of the seats 42. The seats 42 each have an annular wall 47 extending toward the conductive elastic plates 46. The annular walls 47 of the seats 42 are spaced apart so that the seats 42 and the annular walls 47 separate respective second ends 452 of the conductive rings 45. Respective first ends (43*a*, 451) of the first conductive elements 43 (the conductive rings 45) protrude in the direction away from the second conductive elements 44 (the conductive elastic plates 46). Respective first ends (44*a*, 461) of the second conductive elements 44 (the conductive elastic plates 46) are fixed ends, and are fixed to the light module 23 at an interval. Respective second ends (44*b*, 462) of the second conductive elements 44 (the conductive elastic plates 46) are open ends.

In this way, the light housing 10 and the light module 23 can be quickly connected through the locking slots 31 and the locking members 32. When the light housing 10 and the light module 23 are connected, a second end 4312 of the first positive conductive element 431 is elastically abutted against and electrically connected to a second end 4412 of the second positive conductive element 441, and a second end 4322 of the first negative conductive element 432 is elastically abutted against and electrically connected to a second end 4422 of the second negative conductive element 442, so as to complete the electrical connection between the light housing 10 and the light module 23. The assembly and electrical connection between the light housing 10 and the light module 23 can be quickly completed at the same time. The light housing 10 and the light module 23 can be disassembled quickly to release the electrical connection, thereby improving the convenience in use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ceiling fan light structure, electrically connected to a power source, the power source having a power source positive electrode and a power source negative electrode, the ceiling fan light structure comprising:

a light housing;

a light module having a light positive electrode and a light negative electrode;

a coupling unit, including a plurality of locking slots and a plurality of locking members, the locking slots being disposed on one of the light housing and the light module, the locking members being disposed on the other one of the light housing and the light module, the locking members corresponding to the locking slots, the locking members being fastened to the locking slots, respectively;

a conductive unit, including a plurality of conductive elements, the conductive elements each having a first end and a second end, the conductive elements including two first conductive elements that are spaced apart from each other and connected to the light housing and two second conductive elements that are spaced apart from each other and connected to the light module, the first conductive elements being not electrically connected to each other, the second conductive elements being not electrically connected to each other, one of the first conductive elements and the second conductive elements being flexible, the first conductive elements being defined as a first positive conductive element and a first negative conductive element, a first end of the first positive conductive element being electrically connected to the power source positive electrode, a first end of the first negative conductive element being electrically connected to the power source negative electrode, the second conductive elements being defined as a second positive conductive element and a second negative conductive element, a first end of the second positive conductive element being electrically connected to the light positive electrode, a first end of the second negative conductive element being electrically connected to the light negative electrode;

wherein the light housing and the light module are quickly connected through the locking slots and the locking members, when the light housing and the light module are connected, a second end of the first positive conductive element is elastically abutted against and electrically connected to a second end of the second positive conductive element, and a second end of the first negative conductive element is elastically abutted against and electrically connected to a second end of the second negative conductive element, so as to complete an electrical connection between the light housing and the light module.

2. The ceiling fan light structure as claimed in claim 1, wherein the first conductive elements are one of two conductive rings and two conductive elastic plates, and the second conductive elements are the other one of the two conductive rings and the two conductive elastic plates.

3. The ceiling fan light structure as claimed in claim 2, wherein the conductive unit further includes three seats made of an insulating material, the conductive rings are each fastened between every adjacent two of the seats, the seats each have an annular wall extending toward the conductive elastic plates, and the annular walls of the seats are spaced apart so that the seats and the annular walls separate respective second ends of the conductive rings.

4. The ceiling fan light structure as claimed in claim 2, wherein respective first ends of the conductive rings protrude in a direction away from the conductive elastic plates.

5. The ceiling fan light structure as claimed in claim 2, wherein respective first ends of the conductive elastic plates are fixed ends, and respective second ends of the conductive elastic plates are open ends.

6. The ceiling fan light structure as claimed in claim 2, wherein the first conductive elements are the two conductive rings, and the second conductive elements are the two conductive elastic plates.

7. The ceiling fan light structure as claimed in claim 3, wherein the first conductive elements are the two conductive rings, and the second conductive elements are the two conductive elastic plates.

8. The ceiling fan light structure as claimed in claim 7, wherein respective first ends of the first conductive elements protrude in a direction away from the second conductive elements.

9. The ceiling fan light structure as claimed in claim 8, wherein respective first ends of the second conductive elements are fixed ends, and respective second ends of the second conductive elements are open ends.

10. The ceiling fan light structure as claimed in claim 1, wherein one side of each engaging slot is a closed end for locking a corresponding one of the locking members in position, another side of each engaging slot, adjacent to the corresponding locking member, is recessed to form a groove extending toward the corresponding locking member, the another side of each engaging slot is an open end, the grooves of the locking slots correspond to the locking members, and the grooves of the locking slots are configured to accommodate the locking members.

* * * * *